United States Patent [19]

Garfield

[11] Patent Number: 4,530,267

[45] Date of Patent: Jul. 23, 1985

[54] RHYTHM CONTROLLER

[76] Inventor: Daniel J. Garfield, 249 W. Linden Ave., Burbank, Calif. 91502

[21] Appl. No.: 473,046

[22] Filed: Mar. 7, 1983

[51] Int. Cl.[3] ..... G10F 1/00

[52] U.S. Cl. ..... 84/1.03; 84/DIG. 12

[58] Field of Search ..... 84/DIG. 12, 1.03, 1.24; 364/703; 328/14, 16, 30

[56] References Cited

U.S. PATENT DOCUMENTS

| | | | |
|---|---|---|---|
| 3,970,954 | 7/1976 | Even | 364/703 |
| 4,010,667 | 3/1977 | Kniepkamp | 84/1.03 |
| 4,086,471 | 4/1978 | Takahashi | 235/92 |
| 4,244,027 | 1/1981 | Shai | 364/703 |
| 4,419,918 | 12/1983 | Dyck et al. | 84/1.03 |

FOREIGN PATENT DOCUMENTS

| | | |
|---|---|---|
| 0009084 | 2/1981 | France . |
| 1440390 | 6/1976 | United Kingdom . |
| 1470457 | 4/1977 | United Kingdom . |
| 1481616 | 8/1977 | United Kingdom . |
| 2052815 | 2/1983 | United Kingdom . |

*Primary Examiner*—Forester W. Isen

*Attorney, Agent, or Firm*—Frederic P. Smith

[57] ABSTRACT

A rhythm controller for producing a selected number of clock pulses for a musical beat interval comprising an oscillator, first and second counters coupled to the oscillator and a divider coupling the first counter to the oscillator to reduce the output frequency of the oscillator to the first counter. Input means generates a pulse at the onset of each beat interval and enables the first counter to count the divided output of the oscillator for a first beat interval. A comparator receives the count of the first counter, compares the count for the first beat interval with the count of the second counter and produces a clock pulse upon a coincidence. The clock pulse resets the second counter which continues to recount and to be reset after each coincidence until the end of a beat interval, thereby causing a selected number of clock pulses, i.e., a timebase, to be produced for the first beat interval. A divider is coupled to the output of the comparator to produce one or more additional selected numbers of clock pulses (timebases) for each beat interval. Pulse shaping means can be coupled to the divider to produce a sequence of rhythm envelopes triggered by the clock pulses. Selection means coupled to the divider means is also provided to select the desired number of clock pulses (timebases) for a musical beat interval.

5 Claims, 3 Drawing Figures

RHYTHM CONTROLLER

TECHNICAL FIELD

The invention relates to the field of controllers and, in particular, to a rhythm controller suitable for synchronizing microprocessor-based musical instruments with one another and with recorded live music.

BACKGROUND ART

There exists a type of music production in film, record work and live productions which involve the usage of microprocessor-based musical instruments known as synthesizers, sequencers and drum machines. A synthesizer is an electronic device which creates musical sound generally through the use of a keyboard and various control dials coupled to one or more oscillators, filters, amplifiers and envelope generators. A sequencer is a device which stores pitch and rhythm information, typically from a synthesizer, and plays back such information to control the pitch and rhythm of a synthesizer. A drum machine is a percussion sequencer which stores pulse counts representing the time between the triggering of percussion sounds which are then replayed either by analog circuitry or from ROMs containing digital recordings of real instruments.

As is apparent, when these instruments are used with one another or with recorded live music, it is essential that synchronization exists between the various musical sources. This synchronization involves such problems as matching timebase (clock pulses per musical beat interval) and polarity between musical instruments, rhythmic drift in synthesizers, transformation of metronome click tracks into timebase clocks, and enabling sequencers, drum machines and synthesizers to play with the varying tempos of a live track, such as a human drummer or a built click track, such tracks generally being recorded on magnetic tape.

Accordingly, it is a general object of the present invention to provide a novel rhythm controller.

It is another object of the present invention to provide a rhythm controller that can match timebase and polarity between musical instruments.

It is a further object of the present invention to provide a rhythm controller which can transform metronome click tracks into timebase clocks.

It is still another object of the present invention to provide a rhythm controller that can enable sequencers, drum machines and synthesizers to play with the varying tempos of a human drummer or a built click track.

It is still a further object of the present invention to provide a rhythm controller that can be used to eliminate rhythmic drift in synthesizers.

DISCLOSURE OF INVENTION

A rhythm controller for producing a selected number of clock pulses for a musical beat interval is provided. The rhythm controller comprises an oscillator, first and second counters coupled to the oscillator and a divider coupling the first counter to the oscillator to reduce the output frequency of the oscillator to the first counter. Input means generates a pulse at the onset of each beat interval and enables the first counter to count the divided output of the oscillator for a first beat interval. A comparator receives the count of the first counter, compares the count for the first beat interval with the count of the second counter and produces a clock pulse upon a coincidence. The clock pulse resets the second counter which continues to recount and to be reset after each coincidence until the end of a beat interval, thereby causing a selected number of clock pulses, i.e., a timebase, to be produced for the first beat interval. Where a timebase is to be generated for a live track with varying beat intervals, a memory is coupled to the input means to record the count of the first counter during the first and subsequent beat intervals. The input means subsequently clocks the playback of the count from the memory and resets the second counter at the onset of each beat interval to cause a selected number of clock pulses to be produced for each beat interval irrespective of the length of the beat interval. A divider is coupled to the output of the comparator to produce one or more additional selected numbers of clock pulses (timebases) for each beat interval. Pulse shaping means can be coupled to the divider to produce a sequence of rhythm envelopes triggered by the clock pulses. Selection means coupled to the divider means is also provided to select the desired number of clock pulses (timebases) for a musical beat interval.

The novel features which are believed to be characteristic of the invention, both as to its organization and its method of operation, together with further objects and advantages thereof, will be better understood from the following description in connection with the accompanying drawings in which a presently preferred embodiment of the invention is illustrated by way of example. It is to be expressly understood, however, that the drawings are for purposes of illustration and description only and are not intended as a definition of the limits of the invention.

BEST MODE FOR CARRYING OUT THE INVENTION

Figure 1:
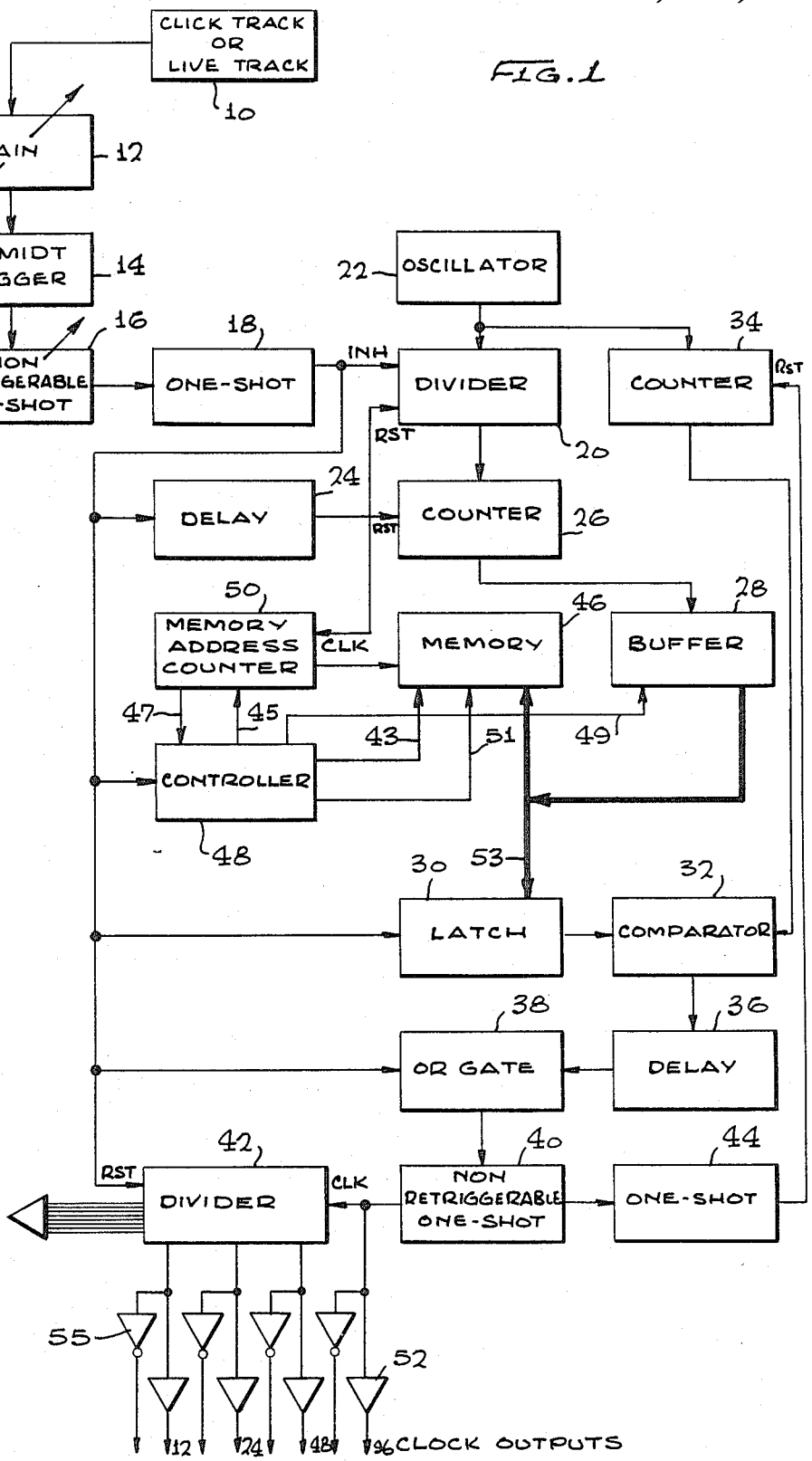
FIG. 1 is a block schematic diagram of the present invention.

Referring now to FIG. 1, a block schematic diagram of the present invention is illustrated. Block 10 provides the input to the present invention in the form of, for example, a click track, i.e., a sequential or metronome pulse input, or a live track, such as a human performer, prerecorded on a magnetic tape. The click track or the live track provides input in timebase 1, i.e., one pulse per musical beat interval, which is converted by the present invention into a number of timebases, such as 12, 24, 48 and 96, for selection by the performer depending on the requirements of the instruments used.

The input is amplified by variable gain 12 and coupled to Schmidt trigger 14 and variable non-retriggerable one-shot 16. The pulse width of the non-retriggerable one-shot 16 is adjusted so that it is ready to fire a pulse only at the beginning of a beat interval and is able to ignore any pulses coming into it during the beat interval, thus acting as a filter for any kind of input or track that has more than, for example, a quarter note beat on it, such as a live drummer. The output of the non-retriggerable one-shot 16 is coupled to 1 microsecond one-shot 18 which inhibits divider 20 coupled to oscillator 22. The output of the one-shot 18 is also coupled to a 1 microsecond delay 24, the output of which resets the divider 20 and counter 26. The divider 20 is chosen to divide the output of the oscillator 22 by a factor of 96 and present such divided output to the counter 26, which may be a 16 bit counter.

The counter 26 is coupled by tri-state buffer 28 to a 16 bit latch 30. Latch 30 is coupled to the one-shot 18 and a 16 bit comparator 32. Also coupled to the comparator 32 is a 16 bit counter 34 directly coupled to the oscillator 22. The output of the comparator 32 is coupled to delay 36, OR gate 38 and a non-retriggerable 1 millisecond one-shot 40. The one-shot 40 is coupled to dividers 42 and 1 microsecond one-shot 44 which is coupled to counter 34. The output of the one-shot 18 is also coupled to OR gate 38 and dividers 42.

In operation, the counter 26 counts the divided output of the oscillator 22 during a first beat interval after having been reset by the pulse from delay 24. At the onset of the next beat interval, the one-shot 18 clocks the count into latch 30 and resets counter 34 through OR gate 38, one-shot 40 and one-shot 44. The count from counter 34 is then compared by comparator 32 with the count in latch 30 and each time a coincidence occurs a clock pulse is produced by comparator 32 which acts to reset counter 34 through delay 36, OR gate 38, one-shot 40 and one-shot 44. Counter 34 then recounts until another coincidence occurs and is then reset as before. Since counter 34 is counting 96 times faster than counter 26 because of divider 20, 96 coincidences or clock pulses will occur before the onset of the next beat interval, assuming all beat intervals are of equal duration, when a pulse from one-shot 18 will again act to inhibit divider 20, clock the newly accumulated count of counter 26 into latch 30, reset counter 34 and, through delay 24, reset divider 20 and counter 26 to count during such next beat interval. The clock pulses from one-shot 40 are coupled to divider 42 which operates to convert the timebase 96 (96 clock pulses per musical beat interval) into timebases 12, 24 and 48, or a number of other timebases, as explained hereinafter. Divider 42 is also reset at the beginning of each beat interval by one-shot 18.

Since it is necessary that only 96 coincidences occur before the onset of a next beat interval to produce a timebase 96 and that the pulse from one-shot 18 arrives at OR gate 38 before a 97th coincidence occurs, delay 36 produces a 3 microsecond delay each time a clock pulse is produced by comparator 32, resulting in a 288 microsecond delay overall. This delay is in actuality reduced by approximately 66 microseconds since there will always be an uncounted remainder that did not get turned into a pulse by divider 20 when it is inhibited by one-shot 18 at the onset of a new beat interval. Thus the pulse from one-shot 18 will always arrive at OR gate 38 and one-shot 40 before the 97th clock pulse is produced. Since one-shot 40 produces a one millisecond pulse, the 97th clock pulse is ignored by one-shot 40, thus producing a true timebase 96. As stated previously, the output of one-shot 40 then resets counter 34 through one-shot 44.

In the embodiment described above, the timebase 96 is produced by coincidencing in comparator 32 the count of counter 26 for a given musical beat interval against the count of counter 34 during the following beat interval. While this is satisfactory for a steady beat, such as a click track or a metronome track, for a built click track or a live track, where the beat intervals are generally different in length, it is desirable to produce the timebase using the same musical beat interval. To accomplish this, memory 46 is provided coupled to buffer 28, latch 30, controller 48 and memory address counter 50. Controller 48 directs memory 46 via line 43 to record incoming data. In operation, controller 48 coupled to one-shot 18 holds the memory address counter 50 at zero via line 45 and initializes the memory 46 to location zero. After the first pulse comes in from one-shot 18 indicating the onset of the first beat interval, 1 microsecond delay 24 then advances counter 50. Controller 48 then causes memory 46, at the conclusion of the first beat interval, by a pulse to controller 48 from one-shot 18, to record the count accumulated by counter 26 during the first beat interval. Such pulse also increments counter 50 1 microsecond later through delay 24. Line 47 is provided to indicate an overflow condition in counter 50 as the live track from block 10 continues to provide pulses. Buffer 28 continues to be active during the recording operation. Thus during this operation, a count is recorded in memory 46 for each beat interval on the live track.

The live track is then rewound and played back. During playback, buffer 28 is inactivated by controller 48 via line 49 and controller 48 holds the counter 50 at one and initializes memory 46 to one. Controller 48 also directs memory 46, via line 51, to place the count stored in memory address one onto data bus 53. When a pulse comes in from one-shot 18, it clocks the count on data bus 53 into the latch 30 and resets counter 34, as described previously. Comparator 32 then proceeds to produce clock pulses by coincidences between counter 34 and the count on latch 30 to produce a timebase 96. Counter 50 is advanced through delay 24 to memory address two 1 microsecond after the pulse comes in from one-shot 18. Upon the onset of the next beat interval, the latch 30 latches the next count on data bus 53, having been placed there by memory 46, to produce a timebase 96 for the next beat interval, which as stated above, can differ in length from the previous beat interval. In this manner an entire live track can be outputted in timebase 96 with variable beat intervals. This output can be used, in the selected timebase, to replace the internal clocks of a plurality of musical instruments and thus synchronize the outputs of such musical instruments. Through buffers 52 or inverting buffers 55, the polarity of the inputs of the musical instruments can also be matched.

Figure 2:
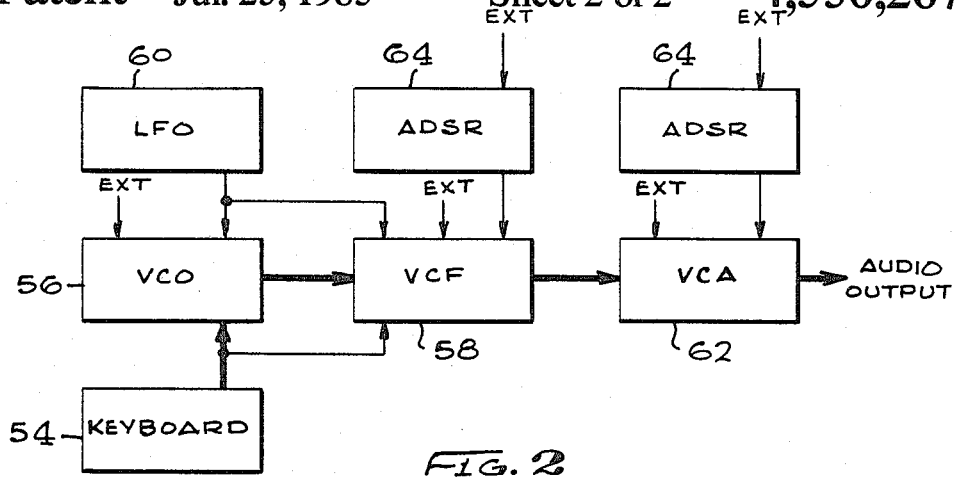
FIG. 2 is a block schematic diagram of a synthesizer.

The rhythm controller is also adapted to eliminate rhythmic drift in synthesizer modulation. Referring now to FIG. 2, a block diagram of a synthesizer is illustrated. A keyboard 54 is coupled to a voltage controlled oscillator (VCO) 56 and a voltage controlled filter (VCF) 58. A key which is held down is converted to a bias voltage which is used to control the pitch of oscillator 56 or the cutoff frequency of filter 58. The oscillator 56 is coupled to a low frequency oscillator (LFO) 60, which is also coupled to filter 58, which typically operates over the range of 0.1 Hz to 20 Hz and is used to modulate the pitch of oscillator 56 and the cutoff frequency of filter 58. The oscillator 56 may provide ramp, sine, square or variable pulse width wave shapes and is the originator of the snythesized sound. The filter 58 is coupled to a voltage controlled amplifier 62 (VCA) which operates to control the audio output of the synthesizer. The filter 58 and the amplifier 62 are also controlled by envelope generators 64 of the attack-decay-sustain-release type (ADSR). The generators 64 create waveforms which are used to control VCO pitch, VCO pulse width, VCF cutoff frequency or VCA volume.

In operation, the generator 64 generates a voltage envelope which attacks to its maximum level in a time determined by an attack control setting, decays at a time determined by a decay control setting to a sustain level determined by a sustain control setting and then decays to zero at a time determined by a release control setting. The gating of the generators 64 are controlled by an external source or can be controlled from the keyboard 54. External voltage sources can also be used to control oscillator 56, filter 58 and amplifier 62. One of the external voltage sources, as stated previously, is a sequencer, which initially stores pitch and rhythm information in the form of control and gate voltages, respectively, from a synthesizer. Over the duration of each pitch, clock pulses are counted by the sequencer and then stored in a memory with the pitch information. In playback mode, each pitch which was recorded in memory is recalled in its turn and controls the synthesizer for a time relative to its associated clock pulse count.

Figure 3:
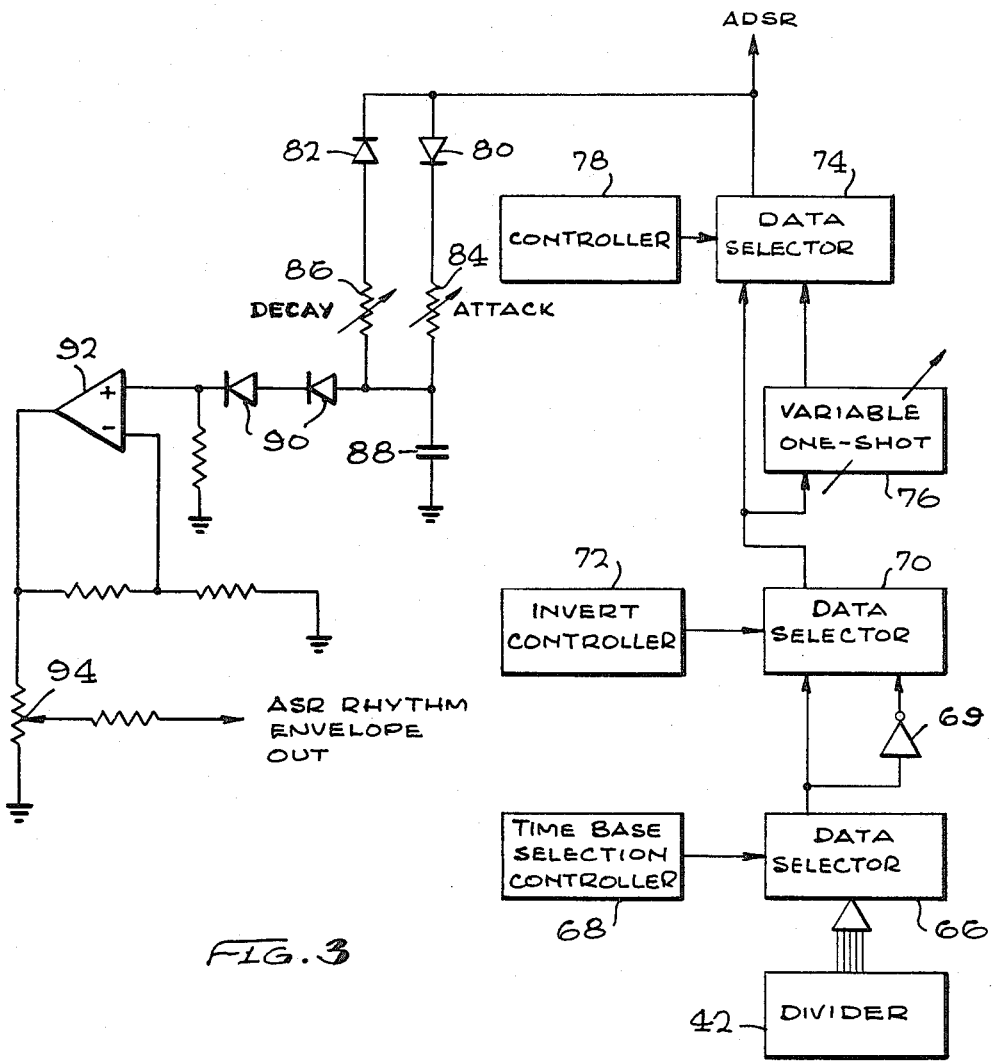
FIG. 3 is a partial block, partial schematic diagram of a feature of the present invention.

In the generation of music from the synthesizer, there has always been an inherent synchronization and drift problem since the LFO is not locked in any way to the tempo of the music. Thus if an ADSR envelope can be rhythm controlled, i.e., locked into a multiple or submultiple of the tempo of the music, this synchronization and drift problem can be controlled. Referring now to FIG. 3, the output of divider 42 is coupled to data selector 66 which is controlled by timebase selection controller 68. Divider 42 is designed to put out, in addition to the timebases shown in FIG. 1, timebases 8, 6, 4, 3, 2, 3/2, 1, 3/4, 1/2, 3/8, 1/4, 3/16, 1/8, 1/16. These timebases, selected by controller 68, can then be inputted into generators 64 to trigger, or gate, the ADSR envelopes or can be used to produce ASR envelopes and thus provide rhythm control.

In this regard, the output from data selector 66 is inputted to inverter 69 which is coupled to data selector 70 and is also inputted directly to data selector 70, controlled by invert controller 72. Controller 72 determines whether the waveforms of the selected timebase should be inverted, thus shifting the selected rhythm by half of its note value. The output of data selector 70 is coupled directly to data selector 74 and also to variable one-shot 76 which is in turn coupled to data selector 74. Controller 78, coupled to data selector 74, is used to select whether the output of data selector 74 is a series of square waves or, by varying one-shot 76, a series of pulses of variable width. The output of data selector 74 can then be used to gate an ADSR envelope generator, such as generator 64 and/or to generate an ASR (Attach-Sustain-Release) rhythm envelope.

In the case when an ASR rhythm envelope is being generated, the output of data selector 74 is coupled to diodes 80, 82 and potentiometers 84, 86 which are used, in conjunction with capacitor 88, to determine the attack and decay (release) characteristics of the rhythm envelope. The sustain portion of the rhythm envelope has previously been determined by the width of the pulse selected by controller 78 and one-shot 76. The diodes 90 coupled to potentiometers 84, 86 trim off any residual voltage which remains on capacitor 88 due to diode 82. Amplifier 92 coupled to diodes 90 steps the peak voltage of the envelope up to, for example, 12 volts. Potentiometer 94 coupled to the output of amplifier 92 sets the amplitude of the final rhythm envelope. This envelope is then coupled to, for example, filter 58 and amplifier 62 in replacement of generators 64 and effectively serves to eliminate rhythmic drift.

Having thus described the invention, it is obvious that numerous modifications and departures may be made by those skilled in the art. For example, the pulses applied to counters 26 and 34 may be generated by separate phase-locked oscillators whose frequencies differ by a selected factor, or such pulses may be generated by the same oscillator with the number of pulses to counter 34 being multiplied by such selected factor. Thus, the invention is to be construed as being limited only by the spirit and scope of the appended claims.

Industrial Applicability

The rhythm controller is useful for synchronizing microprocessor based musical instruments with one another, with click tracks and with recorded live music.

I claim:

1. A rhythm controller adapted to be coupled to a source of input signals, said source being capable of producing a plurality of input signals beginning at the onset of and continuing during a musical beat interval, for producing a selected number of clock pulses for said musical beat interval comprising:

an oscillator;

first and second counters coupled to said oscillator to count the output thereof;

divider means coupling said oscillator and said first counter to selectively reduce the output frequency of said oscillator to said first counter, thereby lowering the counting rate of said first counter;

input means for generating a pulse at the onset of each beat interval for enabling said first counter to count the divided output of said oscillator for a first beat interval, said input means including means for causing said input means to generate a pulse only at the onset of each beat interval and to filter out or ignore any input signals arriving during said beat interval;

comparator means adapted to receive the count of said first counter for comparing said count for said first beat interval with the count of said second counter during a second subsequent beat interval and for producing a clock pulse upon a coincidence, said clock pulse being operative to reset said second counter, said second counter continuing to recount and to be reset after each coincidence until the end of a beat interval;

whereby a selected number of clock pulses are produced for said first beat interval.

2. A rhythm controller for producing a selected number of clock pulses for a musical beat interval comprising:

an oscillator;

first and second counters coupled to said oscillator to count the output thereof;

divider means coupling said oscillator and said first counter to selectively reduce the output frequency of said oscillator to said first counter, thereby lowering the counting rate of said first counter;

input means for generating a pulse at the onset of each beat interval for enabling said first counter to count the divided output of said oscillator for a first beat interval and for resetting said divider means and said first counter;

delay means coupled to said divider means and said first counter to reset said divider means and said first counter a selected time after the onset of said beat interval;

comparator means adapted to receive the count of said first counter for comparing said count for said first beat interval with the count of said second counter during a second subsequent beat interval and for producing a clock pulse upon a coincidence, said clock pulse being operative to reset said second counter, said second counter continuing to recount and to be reset after each coincidence until the end of a beat interval;

whereby a selected number of clock pulses are produced for said first beat interval.

3. A rhythm controller for producing a selected number of clock pulses for a musical beat interval comprising:

an oscillator;

first and second counters coupled to said oscillator to count the output thereof;

divider means coupling said oscillator and said first counter to selectively reduce the output frequency of said oscillator to said first counter, thereby lowering the counting rate of said first counter;

input means for generating a pulse at the onset of each beat interval for enabling said first counter to count the divided output of said oscillator for a first beat interval and for inhibiting said divider means and said first counter for a selected time after the onset of said beat interval;

comparator means adapted to receive the count of said first counter for comparing said count for said first beat interval with the count of said second counter during a second subsequent beat interval and for producing a clock pulse upon a coincidence, said clock pulse being operative to reset said second counter, said second counter continuing to recount and to be reset after each coincidence until the end of a beat interval;

whereby a selected number of clock pulses are produced for said first beat interval.

4. A rhythm controller for producing a selected number of clock pulses for a musical beat interval comprising:

an oscillator;

first and second counters coupled to said oscillator to count the output thereof;

divider means coupling said oscillator and said first counter to selectively reduce the output frequency of said oscillator to said first counter, thereby lowering the counting rate of said first counter;

input means for generating a pulse at the onset of each beat interval for enabling said first counter to count the divided output of said oscillator for a first beat interval and for resetting said second counter at the onset of each beat interval;

comparator means adapted to receive the count of said first counter for comparing said count for said first beat interval with the count of said second counter during a second subsequent beat interval and for producing a clock pulse upon a coincidence, said clock pulse being operative to reset said second counter, said second counter continuing to recount and to be reset after each coincidence until the end of a beat interval; and means coupled to the output of said comparator means to cause to be ignored any pulses produced by said comparator means exceeding said selected number of clock pulses, said means coupled to the output of said comparator means including delay means and means for filtering out any clock pulses produced by said comparator means after said input means acts to reset said second counter;

whereby a selected number of clock pulses are produced for said first beat interval.

5. A rhythm controller for producing a selected number of clock pulses for a musical beat interval comprising:

an oscillator;

first and second counters coupled to said oscillator to count the output thereof;

divider means coupling said oscillator and said first counter to selectively reduce the output frequency of said oscillator to said first counter, thereby lowering the counting rate of said first counter;

input means for generating a pulse at the onset of each beat interval for enabling said first counter to count the divided output of said oscillator for a first beat interval;

comparator means adapted to receive the count of said first counter for comparing said count for said first beat interval with the count of said second counter during a second subsequent beat interval and for producing a clock pulse upon a coincidence, said clock pulse being operative to reset said second counter, said second counter continuing to recount and to be reset after each coincidence until the end of a beat interval; and means coupled to the output of said comparator means to cause to be ignored any pulses produced by said comparator means exceeding said selected number of clock pulses;

whereby a selected number of clock pulses are produced for said first beat interval.

* * * * *